US005463450A

United States Patent [19]

Inoue et al.

[11] Patent Number: 5,463,450

[45] Date of Patent: Oct. 31, 1995

[54] CHARGING DEVICE FOR APPLYING AN OSCILLATING VOLTAGE TO A MEMBER TO BE CHARGED

[75] Inventors: Takahiro Inoue; Masahiro Goto; Hiroshi Sasame, all of Yokohama; Shinichi Tsukida, Okegawa; Manabu Takano, Tokyo, all of Japan

[73] Assignee: Canon Kabushiki Kaisha, Tokyo, Japan

[21] Appl. No.: 232,433

[22] Filed: Apr. 21, 1994

Related U.S. Application Data

[63] Continuation of Ser. No. 921,763, Jul. 30, 1992.

[30] Foreign Application Priority Data

Jul. 31, 1991 [JP] Japan ..... 3-192041

[51] Int. Cl.[6] ..... G03G 15/02

[52] U.S. Cl. ..... 355/219

[58] Field of Search ..... 355/219, 211, 355/212, 213, 271, 274, 276; 361/225; 430/902

[56] References Cited

U.S. PATENT DOCUMENTS

| | | | |
|---|---|---|---|
| 4,455,078 | 6/1984 | Mukai et al. | 355/219 |
| 5,008,706 | 4/1991 | Ohmor et al. | 355/219 |
| 5,089,851 | 2/1992 | Tanaka et al. | 355/219 |
| 5,112,708 | 5/1992 | Okunuki et al. | 361/225 X |
| 5,146,280 | 9/1992 | Kisu | 355/219 |
| 5,164,779 | 11/1992 | Araya et al. | 355/219 |
| 5,272,506 | 12/1993 | Goto | 355/219 |

FOREIGN PATENT DOCUMENTS

| | | | |
|---|---|---|---|
| 0329366 | 8/1989 | European Pat. Off. . | |
| 0151858 | 7/1987 | Japan . | |
| 2-38289 | 10/1990 | Japan . | |
| 3-45981 | 2/1991 | Japan . | |
| 0045978 | 2/1991 | Japan . | |
| 0051266 | 2/1992 | Japan | 355/219 |

*Primary Examiner*—Robert Beatty

*Attorney, Agent, or Firm*—Fitzpatrick, Cella, Harper & Scinto

[57] ABSTRACT

A charging apparatus for electrically charging a member to be charged includes a charging member contactable to the member to be charged to electrically charge the member to be charged. The member to be charged includes a core. A voltage source for applying an oscillating voltage between the member to be charged and the charging member such that a frequency f (Hz) of the oscillating voltage, a Young's modulus $E_1$ ($N/m^2$) of the member to be charged, a Young's modulus $E_2$ of the cure an outer circumferential length 1 (m) of the member to be charged, a thickness $t_1$ (m) of the member to be charged, and a thickness $t_2$ of the core satisfy:

$f1^2/E_1t_1^3+E_2t_2^{3<1.5\times10-2}$ Hz.m (200<f>1500 Hz)

$15001^1/E_3t_1^3+E_2t_2^{3<1.5\times10\ -2}$Hz.m (1500 Hz<f).

20 Claims, 4 Drawing Sheets

CHARGING DEVICE FOR APPLYING AN OSCILLATING VOLTAGE TO A MEMBER TO BE CHARGED

This application is a continuation of application Ser. No. 07/921,763 filed Jul. 30, 1992.

FIELD OF THE INVENTION AND RELATED ART

The present invention relates to a charging (discharging) device contactable to a member to be charged such as an electrophotographic photosensitive member to electrically charge or discharge it, a process cartridge including such a charging device and an image forming apparatus including the same.

The type of charging device is known in the field of an image forming apparatus such as an electrophotographic machine. In this type of device, a charging member in the form of a conductive roller or blade is contacted to the surface of the electrophotographic photosensitive member (the member to be charged), and an oscillating voltage in the form of a DC biased AC voltage is applied therebetween to form an oscillating electric field to charge the photosensitive member.

This type of charging device involves a problem of so-called charging noise produced by the oscillating electric field between the photosensitive member and the charging member. The mechanism by which noise is produced has been found. When the oscillating electric field is formed, the photosensitive member and the charging member are attracted electrostatically to each other. At the maximum and minimum peaks of the oscillating voltage, the attraction force is large, so that the charging member is pressed and deformed to the photosensitive member. At the center of the oscillation, the attraction force is small, and therefore, the charging member tends to be away from the photosensitive member due to the restoration of the charging member. Therefore, vibration is produced at a frequency which is twice the frequency of the oscillating voltage.

The charging member and the photosensitive member rub each other. When the attracting electrostatic force is large at the maximum and minimum peaks of the oscillating voltage, the charging member is attracted strongly to the photosensitive member with the result that relative movement is retarded. On the contrary, at the center of the oscillating voltage, the attracting force is small so that the relative movement is not retarded. Therefore, the vibration is also caused by sticking and slipping, as when a wet glass is rubbed with a finger. This vibration also has a frequency which is twice the frequency of the applied oscillating voltage.

The vibration is a forced vibration caused by the oscillating voltage applied to the charging member, and is in the same phase along the length (generating line direction) of the electrophotographic photosensitive member. Therefore, there is no node or antinode. Thus, the vibration occurs-only in the circumferential direction. It is known as disclosed in Japanese Laid-Open Patent Application No. 5981/1991 that plural vibration buffers are mounted by bonding material to prevent resonance in the direction of the length of the photosensitive drum. However, the above discussed vibrations are totally different ones. In addition, Japanese Laid-Open Utility Model Application Publication 38289/1990 proposes that the inside of a thin metal drum of electrophotographic photosensitive member is filled with foamed material to provide a large thermal capacity and high mechanical strength. However, the filling foamed material isn't effective to suppress the vibration since it does not have the effect of suppressing the forced vibration.

As described, when the oscillating voltage is applied between the charging member and the photosensitive member, the charging noise is generated by vibration. The basic frequency of the noise is twice the frequency of the applied oscillating voltage. If the oscillating voltage includes a 300 Hz AC voltage, the produced noise has the component of 600 Hz. The noise may include a higher frequency which is an integer multiple of that frequency. In some cases, the noise includes the frequency component which is an integer multiple of the frequency of the applied oscillating voltage.

The noise includes "air" noise produced directly from the contact area between the charging member and the photosensitive member and solid noise which is caused by the vibration of the photosensitive member transmitted to the process cartridge and/or to the main assembly of the image forming apparatus and then being caused to generate the noise, wherein the process cartridge includes the photosensitive member and is detachably mountable to the image forming apparatus. In total, the latter noise is more significant.

The charging noise is influenced by the frequency of the oscillating voltage applied to the charging member. More particularly, when the frequency is not more than 200 Hz, the noise is not so significant acoustically or in data applications. However, if it is higher, the noise is increasingly significant acoustically in proportion to the frequency. It generally increases until the frequency is 1000–1500 Hz, including small peaks and valleys due to the resonance of the photosensitive member. Above 1500 Hz, it gradually decreases.

In the case of the contact charging, cycle marks may be produced due to the oscillating electric field between the member to be charged and the charging member supplied with the oscillating voltage. Therefore, when the process speed (the peripheral speed of the photosensitive member) is increased, a higher charging frequency is desired. In the case of the digital image recording as in the laser beam printer, moire patterns are produced due to the combination of the cycle marks and the repeating frequency of the digital image. Therefore, a higher frequency is desired to avoid this problem. However, this tends to increase the charging noise.

Additionally, the recent demand is toward a small size of the image forming apparatus which contains the charging device. When the size is small, the charging noise from the charging device or the process cartridge containing it is not easily absorbed or dissipated in the image forming apparatus. This also increases the charging noise.

SUMMARY OF THE INVENTION

Accordingly, it is a principal object of the present invention to provide a charging device, a process cartridge, and an image forming apparatus in which the charging noise is prevented.

It is another object of the present invention to provide a charging device, a process cartridge, and an image forming apparatus in which the vibration due to deformation of the member to be charged, such as an image bearing member, is effectively prevented.

These and other objects, features, and advantages of the present invention will become more apparent upon a consideration of the following description of the preferred embodiments of the present invention taken in conjunction with the accompanying drawings.

DESCRIPTION OF THE PREFERRED EMBODIMENT

Figure 1:
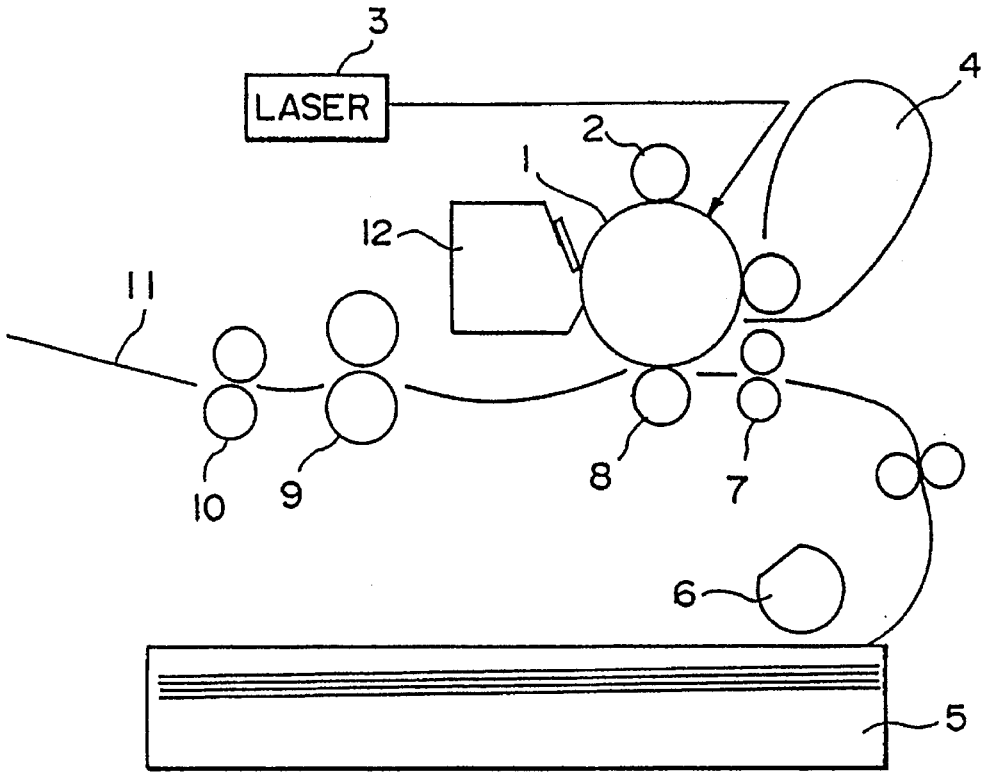
FIG. 1 is a side view of an image forming apparatus according to an embodiment of the present invention.

Referring to FIG. 1, there-is shown an electrophotographic printer as an exemplary image forming apparatus according to an embodiment of the present invention.

The printer comprises an electrophotographic photosensitive drum (the member to be charged) 1, which comprises a photosensitive material such as OPC, amorphous Se, amorphous Si, or the like and a supporting member in the form of a cylinder or belt and made of aluminum or nickel. In this embodiment, the photosensitive drum is in the form of a cylinder. The photosensitive drum 1 is uniformly charged by a charging roller 2. Then, the photosensitive member is raster-scanned in accordance with an image signal from a laser scanner 3. The laser scanner 3 produces a semiconductor laser beam in accordance with image signals, and the beam scans the photosensitive member by way of a polygonal scanner mirror. By doing so, an electrostatic latent image is formed on the photosensitive drum 1. The electrostatic latent image is developed by a developing device 4. As for the development, a jumping development, two component developing method, FEED development are usable. In the developing operation, the toner is deposited onto the area of the photosensitive member where the potential is low due to the laser projection, that is, the reverse development is carried out.

The developed toner image is transferred onto a transfer material. The transfer material is accommodated in a cassette 5. The transfer materials therein are fed out one by one by a pick-up roller 6. When a print signal is produced by a host computer, the transfer material is fed out by the pick-up roller 6. Then, the toner image is transferred onto the transfer material by the transfer roller 8 in synchronism with the image signal, by timing rollers 7. The transfer roller 8 is of electrically conductive and low hardness elastic material. In a nip formed between the photosensitive drum 1 and the transfer roller 8, the toner image is electrostatically transferred onto the transfer material by application of bias electric field.

The transfer material now having the toner image is fixed by an image fixing device 9, and is discharged to the sheet discharge tray 11 by discharging rollers 10. The residual toner particles on the photosensitive drum 1 is removed by a cleaning blade 12.

Figure 2:
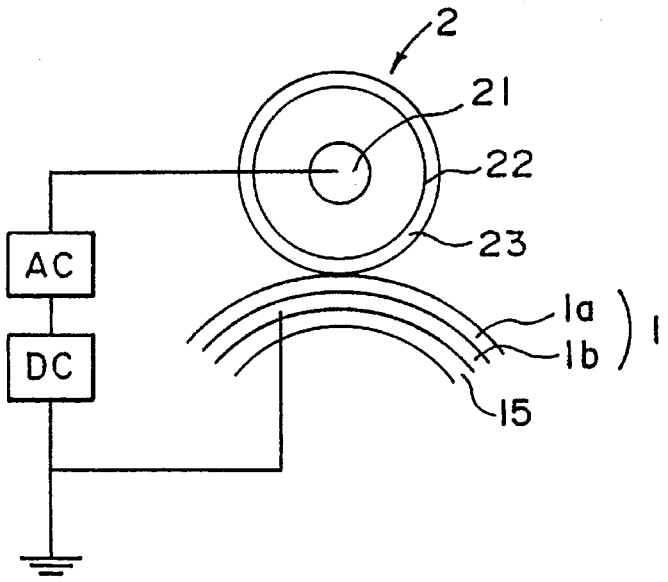
FIG. 2 is a side view of a roller charging device.

FIG. 2 is a side view of a charging device for charging the member to be charged in the form of an image bearing member in this embodiment. The image bearing member is a photosensitive drum 1 in this embodiment and is provided with a photosensitive layer 1*a* made of OPC (organic photoconductor) having a thickness of 20 microns, a conductive base 1*b* made of aluminum or nickel to support the photosensitive layer 1*a* and a core 15. The base member *1*b is electrically grounded.

A charging roller 2 is contactable to the surface of the photosensitive drum 1 and is provided with a conductive core 21, an elastic layer 22 and a surface layer 23.

The core 21 is made of steel, aluminum, stainless steel, or the like. The elastic layer 22 is made of solid or foamed elastic material such as urethane rubber, silicone rubber, EPDM or (ethylene propylene diene percopolymer) in which carbon, $TiO_2$, ZnO, or another metal oxide is added to provide electric conductivity (volume resistivity of $10^3 10^7$ ohm.cm).

The surface layer 23 is a synthetic resin coating of nylon resin such as Toresin (trade name), polyethylene resin, polyester resin, fluorine resin, or polypropylene resin, having been treated for electric conductivity. The volume resistivity thereof is preferably larger than that of the inside elastic layer. By doing so, even if there is pin holes in the surface of the electrophotographic photosensitive layer, the electric current is prevented flowing concentratedly through the pin hole.

Between the photosensitive drum 1 and the charging roller 2, an oscillating voltage in the form of a DC biased AC voltage is applied, so that an oscillating electric field is formed between the photosensitive drum 1 and the charging roller 2, by which the charged voltage or potential of the surface of the photosensitive member is substantially equal to the voltage level of the DC voltage component. As for the oscillating voltage, a rectangular wave form, a triangular wave form, and a sine wave form are usable. Since the sine wave does not contain a higher frequency component, and therefore, the sine wave is preferable because the noise is the least under the same conditions. The oscillating voltage may be a pulse wave form produced by periodically rendering the DC voltage component on and off. In other words, any wave form is usable if the voltage periodically changes with time. The peak-to-peak voltage of the oscillating voltage is preferably not less than twice the absolute value of the charge starting voltage relative to the photosensitive member from the standpoint of preventing spot-like unevenness of the charging.

The peak-to-peak voltage of the oscillating voltage is 1100–3000 V, the frequency thereof is 100–5000 Hz. Preferably, however, the peak-to-peak voltage is 1500–2500 V, and the frequency is 250–1100 Hz.

Figure 3:
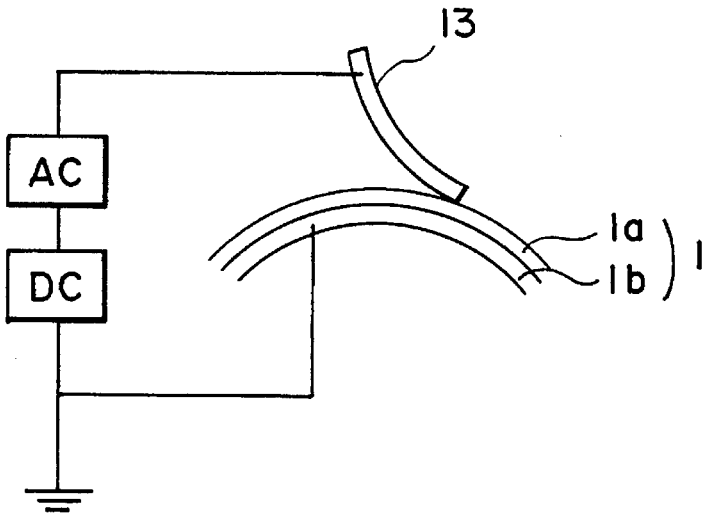
FIG. 3 is a side view of a blade charging device.

Referring to FIG. 3, the contact type charging device includes an elastic blade 13. The elastic blade is made of electrically conductive material such as urethane rubber or silicone rubber. The volume resistivity is adjusted to be $10^3$–$10^7$ ohm.cm. The blade 13 is supplied with a DC biased AC voltage, similarly to the case of the charging roller of FIG. 2.

Figure 4:
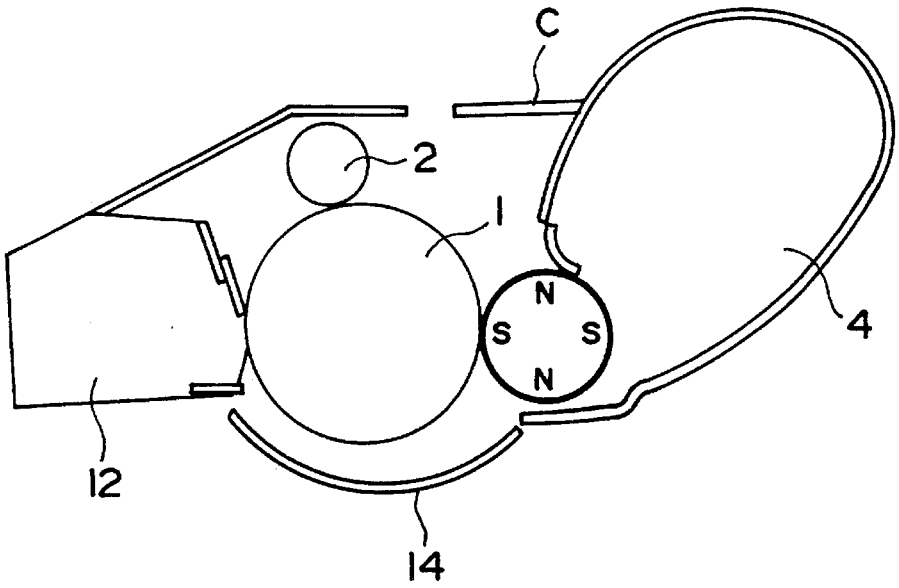
FIG. 4 is a side view of a process cartridge.

Referring to FIG. 4, there is shown a process cartridge detachably mountable to the image forming apparatus. The process cartridge C contains a photosensitive drum 1, a charging roller (charging member) 2, a developing device *4* and a cleaner 12. The process cartridge C is provided with a shutter 14 for protecting the photosensitive drum 1. Here, the process cartridge C may include at least a photosensitive drum (image bearing member) 1 and the charging roller (charging member) 2. In this embodiment, the frequency f of the oscillating voltage is larger than 200 Hz, since then the cyclemark due to the oscillating electric field between the charging member and the member to be charged and, the moire pattern tending to occur during digital image formation, are suppressed.

In addition, the frequency f (Hz) of the oscillating voltage, the Young's modulus E ($N/m^2$), the outer circumferential length of the photosensitive drum 1 (m), and the thickness of the photosensitive drum t (m), satisfy the following:

$fl^2/(Et^3)<1.5\times10^{-2}$ Hz.m ($200<f\leqq1500$ Hz)

$15001^2/(Et^3)<1.5\times10^{-2}$ Hz.m ($1500$ Hz$<f$)

Since the thickness of the photosensitive layer 1*a* is negligibly small as compared with the supporting base plate 1*b* and since the deformation of the photosensitive drum 1 is equivalent to that of the base plate 1*b*, the values E, 1 and t of the photosensitive drum 1 are deemed to be those of the base plate 1*b*. The above relations are obtained empirically on the basis of the following:

that the deformation is proportional to $l^2/(Et^3)$;

that the charging noise is not so significant when the frequency f is not more than 200 Hz;

that the charging noise is increased in proportion to the frequency until 1500 Hz; and that the charging noise gradually decreases with increase of the frequency when the frequency exceeds 1500 Hz.

Figure 5:
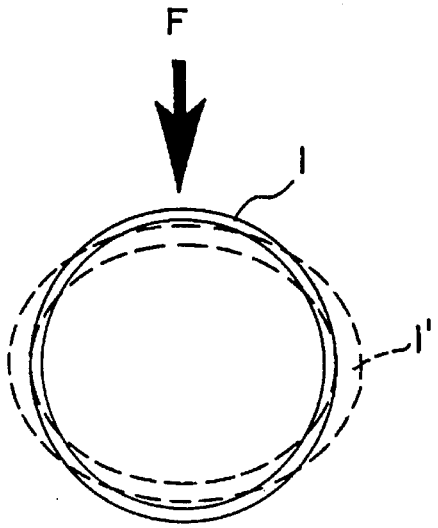
FIG. 5 schematically illustrates deformation of an electrophotographic photosensitive drum.

As shown in FIG. 5, when the charging roller vibrates and beats the photosensitive drum, the photosensitive drum 1 receives force F and deforms as indicated by line 1'. If the deformation is large, the vibration of the photosensitive drum is large, and therefore, it is considered that the produced charging noise is large. This has been confirmed empirically, as follows:

Experiment 1

Figure 6:
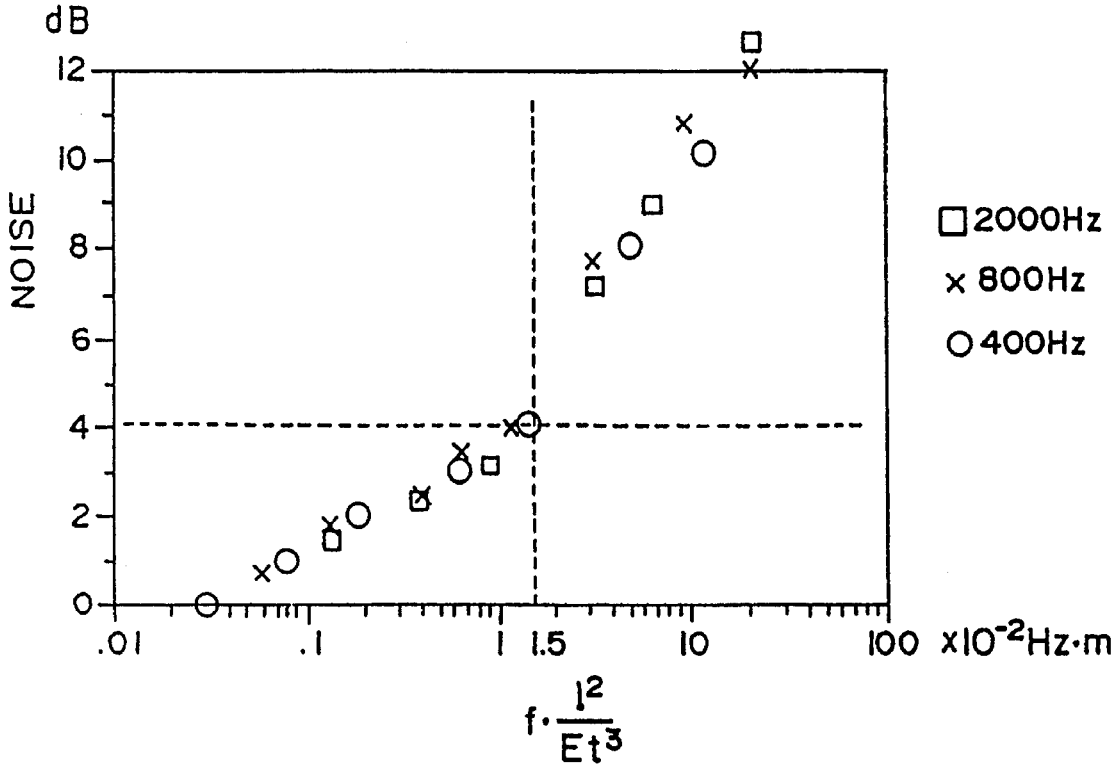
FIG. 6 is a graph of a relation between a charging noise and $f1^2/(Et^3)$.

FIG. 6 shows a relation between a charging noise (JIS-A) and a multiple of a charging frequency and the deformation of the photosensitive member, that is, $fl^2/(Et^3)$, when the peak-to-peak voltage of the oscillating voltage applied to the charging roller of the cartridge shown in FIG. 4 is 2000 Vpp, and the voltage is of a sine wave and has a charging frequency of 400 Hz, 800 Hz and 2000 Hz.

Here, the frequency of 2000 Hz corresponds to $15001^2/(Et^3)$. The frequency of 1500 Hz is used because when the frequency exceeds 1500 Hz, the charging noise gradually decrease with increase of the frequency, and therefore, 1500 Hz corresponds to the most significant charging noise in the range over 1500 Hz.

In the experiments, the aluminum photosensitive cylinder base plates having a diameter of 30 mm and a diameter of 60 mm, respectively, were prepared. The thickness thereof was 0.5–4 mm. The noise meter was placed 50 cm away from the process cartridge. The noise difference between the measured noise and the background noise was determined. The relation with the charging noise was confirmed.

Experiment 2

The process cartridge is incorporated in the electrophotographic printer shown in FIG. 1, and the leaked noise was measured. The printer had a width of 450 mm, a depth of 460 mm and a height of 320 mm. This is a small size printer, and the minimum dimension between the surface of the photosensitive drum and the outer casing is 150 mm.

The noise was measured through a sound power measurement method speculated in ISO7779. The leaked charging noise were checked through panel test by plural persons.

As a result, it has been found that if the charging noise determined through Experiment 1 described above is not more than 4 dB, substantially no noise is heard if the process cartridge is in the main assembly of the printer, because of the blocking effect of the main assembly of the printer, and in addition, it is not noisy acoustically.

Accordingly, it has been confirmed that the charging noise is not significant, when the following is satisfied:

$fl^2/(Et^3)<1.5\times10^{-2}$ Hz.m ($200<f\leqq1500$ Hz)

$15001^2/(Et^3)<1.5\times10^{-2}$ Hz.m ($1500$ Hz$<f$)

In order to investigate the influence of the material, the cylinders having a diameter of 30 mm and thicknesses of 1.0 mm and 1.5 mm and made of aluminum, titanium, duralmin and steel, were prepared. The charging noise was measured under the-application of 400 Hz voltage.

Table 1 and 2 show the results of experiments for the thickness of 1.0 mm and for the thickness of 1.5 mm, respectively.

TABLE 1

| | Young's Modulus ($N/m^2$) | $fl^2/(Et^3)$ (Hzm) | Charging (dB) | Noise |
|---|---|---|---|---|
| Al | $7.03\times10^{10}$ | $5.05\times10^{-2}$ | 8 | Noisy |
| Ti | $11.51\times10^{10}$ | $3.09\times10^{-2}$ | 7 | Noisy |
| Duralmin | $7.15\times10^{10}$ | $4.97\times10^{-2}$ | 8 | Noisy |
| Steel | $21.14\times10^{10}$ | $1.68\times10^{-2}$ | 5 | Slightly Noisy |

TABLE 2

| | Young's Modulus ($N/m^2$) | $fl^2/(Et^3)$ (Hzm) | Charging (dB) | Noise |
|---|---|---|---|---|
| Al | $7.03\times10^{10}$ | $1.50\times10^{-2}$ | 4 | Quiet |
| Ti | $11.51\times10^{10}$ | $0.91\times10^{-2}$ | 3.5 | Quiet |
| Duralmin | $7.15\times10^{10}$ | $0.47\times10^{-2}$ | 4 | Quiet |
| Steel | $21.14\times10^{10}$ | $0.50\times10^{-2}$ | 3 | Quiet |

From these experiments, it will be understood that even if the different materials are used, the charging noise is not significant if the following is satisfied:

$fl^2/(Et^3)<1.5\times10^{-2}$ Hz.m ($200<f\leqq1500$ Hz)

$15001^2/(Et^3)<1.5\times10^{-2}$ Hz.m ($1500$ Hz$<f$)

Figure 7:
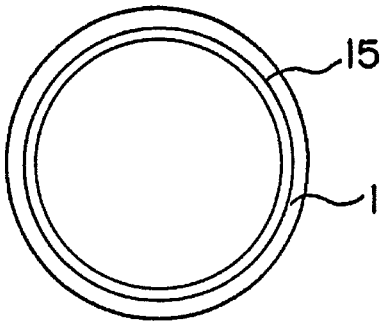
FIG. 7 is a side view of a photosensitive drum containing therein a core.
Figure 8:
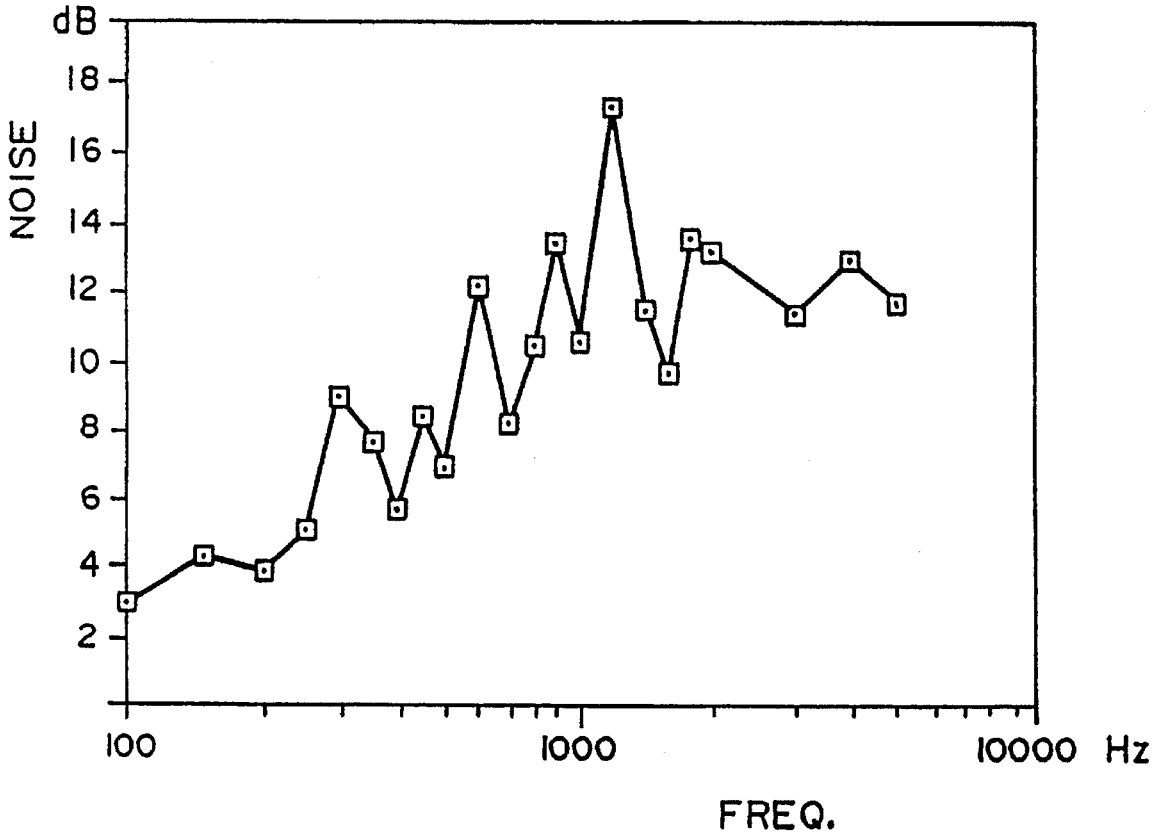
FIG. 8 is a graph of frequency dependency of the charging noise.

In FIG. 7, a different material core 15 is in the photosensitive drum 1. The material of the core is preferably steel, aluminum, stainless steel, titanium, nickel, duralmin, or another metal, since the Young's modulus is large. However, rubber material such as urethane rubber or chloroprene rubber or plastic resin material such as vinyl chloride, ABS resin, polyethylene resin, or the like, are usable if the deformation can be suppressed with sufficient thickness. In order to prevent the deformation of the photosensitive member due to the vibration of the member contacted thereto, such as the charging roller, the core 15 is required to be in contact with the inside surface of the photosensitive drum.

The deformation in this case is determined in consideration of the different Young's modulus of the different materials, as follows:

$$fl^2/(E(t_1+t_2)^3) = fl^2/(E_1t_1^3 + E_2t_2^3) < 1.5\times10^{-2}\ \text{Hzm}$$
$$(200 < f \leqq 1500\ \text{Hz})$$

-continued $$1500l^2/(E(t_1+t_2)^3) = 1500l^2/(E_1t_1^3+E_2t_2^3) < 1.5\times10^{-2}\ \text{Hzm}$$
$$(1500\ \text{Hz} < f)$$

Where $E_1$ is the Young's modulus of the photosensitive drum (photosensitive layer+base member), $t_1$ is a thickness of the photosensitive drum, $E_2$ is a Young's modulus of the core material, $t_2$ is a thickness of the core material, and E is a combined Young's modulus of the photosensitive drum and the core metal. Alternatively, these formulas can be written as $L^2/(E_1t_1^3+E_2t_2^3) < 1.5\times10^{-2}/1500$, f>200; and $L^2/(E_1t_1^3+E_2t_2^3) > 1.5\times10^{-2}/1500$, $f<(E_1t_1^3+E_2t_2^3)/1.5\times10^{-2}L^2$, 200<f<1500.

As described in the foregoing, the deformation of the member to be charged such as the image bearing member, so that the vibration due to the deformation is suppressed, and therefore, the solid noise produced thereby can be reduced, if the frequency f of the oscillating voltage is not less than 200 Hz and if the following is satisfied:

$f1^2/(Et^3)<1.5\times10^{-2}$Hz.m (200<f≦1500 Hz) $15001^2/(Et^3)<1.5\times10^{-2}$ Hz.m (1500 Hz<f)

where E is the Young's modulus of the member to be charged ($N/m^2$), 1 is an outer circumferential length (m), and t is a thickness (m).

Thus, the charging noise generated from the charging device, the process cartridge or the image forming apparatus can be reduced. Even in a small size image forming apparatus where the distance between the image bearing member and the outer casing is small, quiet operation is possible. Accordingly, the environment is improved together with the feature of the contact type charging device that the ozone production is small.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus for charging a member to be charged including a charge bearing member and a core member inside thereof, said apparatus comprising:

a charging member contactable to the member to be charged to electrically charge a surface thereof;

voltage applying means for applying an oscillating voltage between the member to be charged and said charging member;

wherein a frequency f (Hz) of the oscillating voltage, a Young's modulus of said charge bearing member $E_1$($N/m^2$), a Young's modulus of the core member $E_2$($N/m^2$), an outer circumferential length L(m) of the member to be charged, a thickness t1(m) of the charge bearing member, and a thickness t2(m) of the core member, satisfy:

if $L^2/(E_1t_1^3+E_2t_2^3)\leqq1.5\times10^{-2}/1500$, f>200; and if $L_2/(E_1t_1^3+E_2t_2^3)<1.5\times10^{-2}/1500$, $f<(E_1t_1^3+E_2t_2^3)/L^2 1.5\times10^{-2}$ and 200 >f ≧ and 1500.

2. An apparatus according to claim 1, wherein said charging member is in the form of a roller.

3. An apparatus according to claim 1, wherein said charging member is in the form of a blade.

4. An apparatus according to claim 1, wherein the oscillating voltage is in the form of a sine wave.

5. An apparatus according to claim 1 or 4, wherein the oscillating voltage is a DC-biased AC voltage.

6. An image forming apparatus, comprising:

an image bearing member including a charge bearing member and a core member inside thereof;

a charging member contactable to said image bearing member to electrically charge a surface thereof;

voltage applying means for applying an oscillating voltage between said image bearing member and said charging member;

image forming means for forming an image on said image bearing member;

wherein a frequency f (Hz) of the oscillating voltage, a Young's modulus of said charge bearing member $E_1$($N/m_2$), a Young's modulus of the core member $E_2$ ($N/m^2$), an outer circumferential length L(m) of said image bearing member, a thickness t1(m) of said charge bearing member, and a thickness t2(m) of said core member, satisfy:

if 200<f≧1500, $fL^2/(E_1t_1^3+E_2t_2^3)>1.5\times10^{-2}$; and if f<1500, $1500L^2/(E_1t_1^3+E_2t_2^3)<1.5\times10^{-2}$.

7. An apparatus according to claim 6, wherein said charging member is in the form of a roller.

8. An apparatus according to claim 6, wherein said charging member is in the form of a blade.

9. An apparatus according to claim 6, wherein the oscillating voltage is in the form of a sine wave.

10. An apparatus according to claim 6 or 9, wherein the oscillating voltage is a DC-biased AC voltage.

11. An apparatus according to claim 6, wherein said image bearing member has a surface photosensitive layer.

12. A process cartridge detachably mountable to an image forming apparatus, comprising:

an image bearing member including a charge bearing member and a core member inside thereof;

a charging member contactable to said image bearing member to electrically charge a surface thereof wherein an oscillating voltage is applicable between said charging member and said image bearing member;

wherein a frequency f (Hz) of the oscillating voltage, a Young's modulus of said charge bearing member $E_1$($N/m^2$), a Young's modulus of the core member $E_2$($N/m_2$), an outer circumferential length L(m) of said image bearing member, a thickness t1(m) of said charge bearing member, and a thickness t2(m) of said core member, satisfy:

if 200<f≧1500, $fL^2/(E_1t_1^3+E_2t_2^3)<1.5\times10^{-2}$; and if f<1500, $1500L^2/(E_1t_1^3+E_2t_2^3)<1.5\times10^{-2}$.

13. A process cartridge according to claim 12, wherein said charging member is in the form of a roller.

14. A process cartridge according to claim 12, wherein said charging member is in the form of a blade.

15. A process cartridge according to claim 12, wherein the oscillating voltage is in the form of a sine wave.

16. A process cartridge according to claim 12 or 15, wherein the oscillating voltage is a DC-biased AC voltage.

17. An apparatus according to claim 1, wherein said charge bearing member comprises a photosensitive layer and a base supporting said photosensitive layer.

18. An apparatus according to claim 1, wherein the charge bearing member has a Young's modulus different from a Young's modulus of said core member.

19. An apparatus according to claim 1, wherein the charge bearing member and the core member are cylindrical.

20. A process cartridge according to claim 12, wherein said process cartridge has a developing device for developing said image bearing member with toner.

* * * * *

UNITED STATES PATENT AND TRADEMARK OFFICE

CERTIFICATE OF CORRECTION

PATENT NO. : 5,463,450

DATED : October 31, 1995

INVENTOR(S) : TAKAHIRO INOUE, ET AL.

It is certified that error appears in the above-indentified patent and that said Letters Patent is hereby corrected as shown below:

ON THE TITLE PAGE:

At [56] U.S. PATENT DOCUMENTS

"5,008,706 4/1991 Ohmor et al." should read --5,008,706 4/1991 Ohmori et al.--.

At [57] ABSTRACT

Line 9, "cure" should read --core,--;

Line 12, "$f1^2/E_1t_1^3 + E_2t_2^{3<1.50x10-2}$"

should read --$f1^2/(E_1t_1^3 + E_2t_2^3) <1.50 \times 10^{-2}$--, and

"200<f>1500 Hz" should read --$200 < f \leq 1500$ Hz--; and

Line 13, "$15001^1/E_3t_1^3 + E_2t_2^3 < 1.50 \times 10-2$"

should read --"$15001^2/(E_1t_1^3 + E_2t_2^3) < 1.50 \times 10^{-2}$--.

Column 1,

Line 58, "occurs-only" should read --occurs only--; and

Line 60, "No. 5981/1991" should read --No. 45981/1991--.

Column 2,

Line 17, "solid" should read --"solid"--.

Column 3,

Line 65, "is" should read --are--.

UNITED STATES PATENT AND TRADEMARK OFFICE

CERTIFICATE OF CORRECTION

PATENT NO. : 5,463,450

DATED : October 31, 1995

INVENTOR(S) : TAKAHIRO INOUE, ET AL.

It is certified that error appears in the above-indentified patent and that said Letters Patent is hereby corrected as shown below:

Column 4,

Line 7, "member 1b" should read --member 1b--;

Line 15, "EPDM or" should read --or EPDM--;

Line 17, "$10^3 10^7$" should read --$10^3$-$10^7$--;

Line 24, "is" should read --are--;

Line 26, "flowing" should read --from flowing--;

Line 37, "and" should be deleted; and

Line 38, "therefore," should be deleted.

Column 5,

Line 3, "cyclemark" should read --cycle marks--;
Line 4, "and," should read --and--; and
Line 45, "800 Hz" should read --800 Hz,--.

Column 6,

Line 3, "were" should read --was--;
Line 16, "duralmin" should read --duralumin,"
Line 18, "the-application" should read --the application--;
Table 1, "Duralmin" should read --Duralumin--;
Table 2, "Duralmin" should read --Duralumin--; and
Line 50, "duralmin" should read --duralumin--.

UNITED STATES PATENT AND TRADEMARK OFFICE

CERTIFICATE OF CORRECTION

PATENT NO. : 5,463,450

DATED : October 31, 1995

INVENTOR(S) : TAKAHIRO INOUE, ET AL.

It is certified that error appears in the above-indentified patent and that said Letters Patent is hereby corrected as shown below:

Column 7,

Line 12, "$2L^2$," should read --$^2L^2$,--;

Line 51, "t1(m)" should read --$t_1$(m)--;

Line 52, "t2(m)" should read --$t_2$(m)--;

Line 55, "$L_2$" should read --$L^2$--; and

"<1.5" should read -->1.5--; and

Line 56, "200 >f $\geq$ and 1500."

should read --200 < f $\leq$ 1500.--.

UNITED STATES PATENT AND TRADEMARK OFFICE

CERTIFICATE OF CORRECTION

PATENT NO. : 5,463,450

DATED : October 31, 1995

INVENTOR(S) : TAKAHIRO INOUE, ET AL.

It is certified that error appears in the above-indentified patent and that said Letters Patent is hereby corrected as shown below:

Column 8

Line 11, "$m_2$)," should read --$m^2$),--;

Line 13, "t1(m)" should read --$t_1$(m)--;

Line 14, "t2(m)" should read --$t_2$(m)--;

Line 16, "200<f≧ 1500,"
should read --200 < f ≦ 1500,--, and
">1.5x$10^{-2}$" should read --<1.5x$10^{-2}$--;

Line 17, "f < 1500," should read --f > 1500,--;

Line 38, "$E_2$ (N/$m_2$)," should read --$E_2$(N/$m^2$),--;

Line 40, "t1(m)" should read --$t_1$(m)--;

Line 41, "t2(m)" should read --$t_2$(m)--;

Line 43, "200 < f ≧ 1500," should read --200 < f ≦ 1500,--;

Line 44, "f < 1500," should read --f > 1500,--.

Signed and Sealed this

Eleventh Day of June, 1996

*Attest:*

*Attesting Officer*

BRUCE LEHMAN

*Commissioner of Patents and Trademarks*